US005316688A

United States Patent [19]

Gladfelter et al.

[11] Patent Number: 5,316,688

[45] Date of Patent: May 31, 1994

[54] WATER SOLUBLE OR DISPERSIBLE FILM COVERED ALKALINE COMPOSITION

[75] Inventors: Elizabeth J. Gladfelter, Falcon Heights; Tina O. Outlaw, Inver Grove Heights; James L. Copeland; Rhonda K. Schulz, both of Burnsville; Daniel K. Boche, Eagan; Jeff W. Peterson, Minnetonka, all of Minn.

[73] Assignee: Ecolab Inc., St. Paul, Minn.

[21] Appl. No.: 699,688

[22] Filed: May 14, 1991

[51] Int. Cl.[5] ..... C11D 17/00

[52] U.S. Cl. ..... 252/90; 134/6; 134/42; 252/156; 252/174; 252/174.23; 252/DIG. 2; 252/DIG. 3

[58] Field of Search ..... 252/90, 174.23, 174, 252/156, DIG. 2, DIG. 3; 134/4, 6, 42

[56] References Cited

U.S. PATENT DOCUMENTS

| | | | |
|---|---|---|---|
| 3,198,740 | 8/1965 | Dunlop et al. . | |
| 3,413,229 | 11/1968 | Bianco et al. | 252/90 |
| 3,546,716 | 12/1970 | Lauman | 4/12 |
| 3,661,695 | 5/1972 | Berliner | 161/151 |
| 3,790,067 | 2/1974 | Scheier | 229/55 |
| 3,892,905 | 7/1975 | Albert . | |
| 4,372,311 | 2/1983 | Potts | 128/287 |
| 4,551,369 | 11/1985 | Belz | 428/36 |
| 4,612,355 | 9/1986 | Belz . | |
| 4,620,999 | 11/1986 | Holmes | 428/35 |
| 4,672,956 | 6/1987 | Potter et al. | 128/90 |
| 4,762,738 | 8/1988 | Keyes et al. | 428/36 |
| 4,765,916 | 8/1988 | Ogar et al. | 252/DIG. 3 |
| 4,772,663 | 9/1988 | Marten . | |
| 4,828,744 | 5/1989 | Kaufmann et al. . | |
| 4,851,472 | 7/1989 | Famili et al. . | |
| 4,870,148 | 9/1989 | Belz . | |
| 4,885,105 | 12/1989 | Yang et al. | 252/DIG. 3 |
| 4,930,942 | 6/1990 | Keyes et al. | 406/49 |
| 4,948,857 | 8/1990 | Marten et al. . | |
| 4,973,416 | 11/1990 | Kennedy . | |
| 4,990,146 | 2/1991 | Diebig et al. . | |
| 5,108,807 | 4/1992 | Tucker | 428/35.2 |
| 5,181,966 | 1/1993 | Honeycutt et al. | 134/42 |

FOREIGN PATENT DOCUMENTS

| | | | |
|---|---|---|---|
| 0010171 | 9/1979 | European Pat. Off. . | |
| 0407301A1 | 6/1984 | European Pat. Off. . | |
| 0142950 | 10/1984 | European Pat. Off. . | |
| 0226439 | 12/1986 | European Pat. Off. . | |
| 0242966 | 10/1987 | European Pat. Off. . | |
| 0284191 | 2/1988 | European Pat. Off. . | |
| 0337568 | 10/1989 | European Pat. Off. . | |
| 0457600A2 | 11/1991 | European Pat. Off. . | |
| 2022927 | 11/1970 | Fed. Rep. of Germany . | |
| 3017246A1 | 11/1981 | Fed. Rep. of Germany . | |
| 3541153 | 5/1987 | Fed. Rep. of Germany | 252/90 |
| 62-060644 | 3/1987 | Japan . | |
| 2060906A | 1/1988 | Japan . | |
| 2155999A | 11/1988 | Japan . | |
| 2163149A | 3/1989 | Japan . | |
| 2108534 | 4/1990 | Japan . | |
| 2108534A | 4/1990 | Japan . | |
| 3-124734 | 5/1991 | Japan . | |
| WO92/01037 | 1/1992 | PCT Int'l Appl. . | |
| 944053 | 12/1963 | United Kingdom | 252/90 |
| 1384791 | 4/1972 | United Kingdom . | |
| 2083762B | 2/1985 | United Kingdom . | |

OTHER PUBLICATIONS

*Polyox Water-Soluble Resins*, Union Carbide Corporation.

*Polyox Water-Soluble Resins*, Union Carbide Corporation.

*Vinol TM Polyvinyl Alcohols*, Air Products.

*Vinex TM Thermoplastic Polyvinyl Alcohol Copolymer Resins*, Air Products.

Belland Plastics Literature.

Amir Famili et al., "Novel Thermoplastic Polyvinyl Alcohol Copolymer".

Aquafilm limited Product Literature, "Water Soluble Films".

Air Products Product Literature.

*Primary Examiner*—Wayne Langel

*Attorney, Agent, or Firm*—Merchant, Gould, Smith, Edell, Welter & Schmidt

[57] ABSTRACT

The invention is an alkaline cleaning system which includes an alkaline detergent composition having a pH greater than 10.5 when diluted to a 1 wt-% aqueous solution, and an alkali stable continuous polymeric film dispersible or soluble in aqueous liquids covering the detergent composition. The invention also includes methods of using the alkaline cleaning system by applying an aqueous diluent automatically (by machine) or manually through partial or complete dissolution of the film covered solid.

55 Claims, 5 Drawing Sheets

FIG. 13
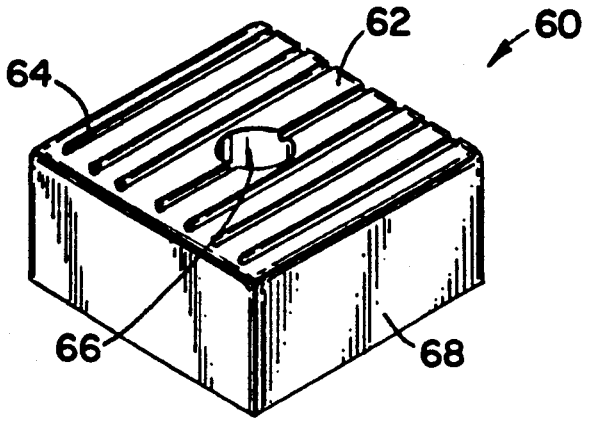
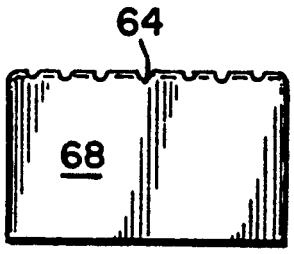
FIG. 14
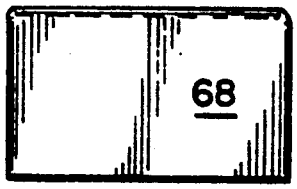
FIG. 15
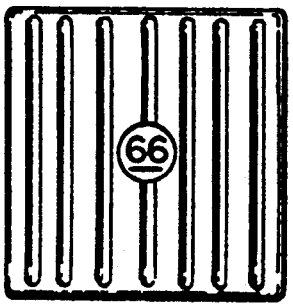
FIG. 16
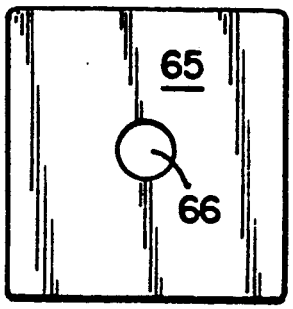
FIG. 17

WATER SOLUBLE OR DISPERSIBLE FILM COVERED ALKALINE COMPOSITION

FIELD OF THE INVENTION

This invention relates generally to alkaline cleaning systems packaged in aqueous soluble or dispersible polymeric films. More specifically, the invention relates to a film covered, contact safe aqueous soluble or dispersible alkaline cleaning composition capable of dispensing a variety of chemical agents including water softening agents, warewashing agents, laundry detergents, sanitizers, as well as any variety of other compositions including highly alkaline materials.

BACKGROUND OF THE INVENTION

Water soluble films have previously been made from polyvinyl alcohol and vinyl acetate resin blends. These chemicals are generally not compatible with any number of chemical systems. For example, these polymers are generally not compatible with chemical systems having a high pH or alkalinity such as caustic (NaOH) or caustic type materials. The alkali reacts with the vinyl acetate portion of the film converting it to vinyl alcohol. Films made of 100 wt-% vinyl alcohol have dramatically reduced water solubility. Moreover, packaged chemical detergents, cleaners, and the like must also be contained in a system which combines strength and structural integrity with storage stability to contain the product during storage and transportation prior to reaching its final end use. At the final location the package has to have enough strength to withstand handling prior to use.

Finally, many chemical cleaners have a highly alkaline nature. As a result, operational handling of these compositions, especially in the environment of use, often creates definite hazards stemming from the premature creation of high pH solutions which may result in severe injury to the operator.

Prior attempts to solve these problems include Torimae, Japanese Patent Document No. 2,163,149 and 0,260,906 which disclose cold water soluble films resulting from a copolymer of itaconic acid and saponified vinyl acetate and modified polyvinyl alcohol films used for packaging solid detergents, respectively; Proctor & Gamble, Japanese Patent No. 2,155,999 which discloses water soluble packages containing liquid detergents, the film generally comprising a vinyl alcohol polymer; Albert, U.S. Pat. No. 3,892,905 which discloses films made of a polymer mixture of polyvinyl alcohol and polyvinyl pyrrolidone; and Japanese Patent No. 2,108,534 to Torimae discloses cold water soluble multilayer films for powder detergent packaging generally comprising vinyl alcohol polymers.

However, while these publications disclose films which generally would be classified as water soluble, there is no discussion regarding the maintenance of water solubility in the face of solids or solutions having an alkaline pH. Moreover, these publications do not disclose the manner in which the solubility of the polymeric films can be controlled generally.

As a result, a need still exists for a package cleaning system which has a high structural integrity and remains alkaline stable, preventing exposure to the operator prior to use and remains aqueous soluble or dispersible even in the presence of, or after contact with highly alkaline solutions.

SUMMARY OF THE INVENTION

The invention is an alkaline cleaning system having an alkaline detergent composition which has a pH greater than 10.5 when diluted to a 1 wt-% aqueous solution which is covered by a continuous polymeric film which remains aqueous soluble or dispersible after exposure to the alkaline detergent.

In accordance with one aspect of the invention, highly alkaline compositions (pH=10.5 or greater), may be wrapped or packaged in a film of high structural integrity and maintained in this state prior to use for an extended period without degradation of the film. In accordance with another aspect of the invention, the films used to package the highly alkaline solid remain water soluble or dispersible throughout packaging and storage into the use application. This aspect of the invention results from a multilayer film having an internal alkali stable layer, an intermediate or outer layer providing structural integrity and physical strength. Alternatively, the multilayer film may have an additional outer layer which is cold water insoluble allowing dissolution only under heated aqueous conditions such as those found in a warewashing or laundry machine. This aspect of the invention prevents operator exposure to the alkaline composition due to solubilization of the film by the wet hands of the operator.

A further aspect of the invention is the block shapes of the invention which offer increased handling ability, assist in uniform dissolution, assist in defining container specific application, and increased aesthetic appeal.

We have discovered a means for storing and dispensing alkaline containing products in water soluble films which provides stable packaging of high structural integrity, and handling protection for operators prior to use. The film may be made into a package useful for containing any number of cleaning or detergent chemicals in granular, compressed solid, or cast solid form.

Any application that requires an alkaline product, for example, warewashing, laundry, clean in place, bottle washing applications, etc., may use this cleaning article. This article is designed for single use or multiple use applications and the ultimate use solution may be prepared manually or by way of a dispensing unit.

BRIEF DESCRIPTION OF THE FIGURES

FIG. 13 is a perspective view depicting a further alternative embodiment of the detergent composition of the invention.

FIG. 14 is a first side plan view of the detergent composition depicted in FIG. 13.

FIG. 15 is a second side plan view of the detergent composition depicted in FIG. 13.

FIG. 16 is a top plan view of the detergent composition shown in FIG. 13.

FIG. 17 is a bottom plan view of the detergent composition shown in FIG. 13.

DETAILED DESCRIPTION OF THE PREFERRED EMBODIMENTS

Figure 1:
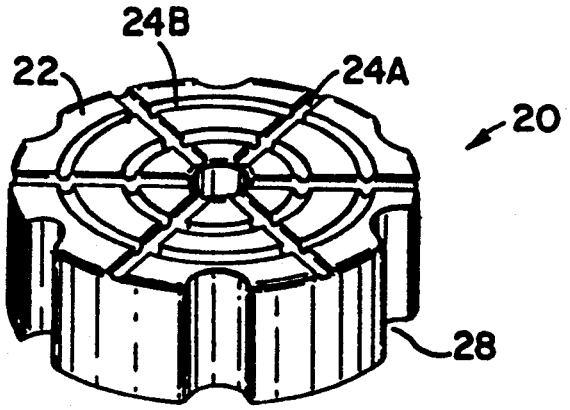
FIG. 1 is a perspective view of one embodiment of the detergent composition of the invention.

The invention combines alkaline detergent compositions packaged in alkaline tolerant polymeric films. The term detergent compositions should be interpreted to include any rinsing, cleaning, conditioning, antimicrobial, preparatory, etc. chemical or other solid composition which has an alkaline pH and may conveniently be packaged in the polymeric film of the invention.

The Detergent Composition

Generally, the composition of the invention includes an alkalinity source and a hardness sequestrant or a builder. Optionally, the composition of the invention may also include a solidifying agent, sanitizing and disinfectant agents, surfactants and any variety of other formulatory and application adjuvants.

A. Source of Alkalinity

In order to provide an alkaline pH, the composition comprises an alkalinity source. Generally, the alkalinity source raises the pH of the composition to at least 10.5 in a 1 wt-% aqueous solutions and generally to a range of from about 10.5 to 14, preferably from about 11 to 13, and most preferably from about 11.5 to 12.5.

This higher pH increases the efficacy of the soil removal and sediment breakdown when the chemical is placed in use and further facilitates the rapid dispersion of soils. The general character of the alkalinity source is limited only to those chemical compositions which have a greater solubility. That is, the alkalinity source should not contribute metal ions which promote the formation of precipitates or film salts. Exemplary alkalinity sources include silicates, hydroxides, phosphates, and carbonates.

Silicates useful in accord with this invention include alkali metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium tetrasilicate monohydrate, or mixtures thereof.

Generally, when a silicate compound is used as the alkalinity source in the present invention, the concentration of the silicate will range from about 5 wt-% to 60 wt-%, preferably from about 15 wt-% to 50 wt-%, and most preferably from about 25 wt-% to 45 wt-%.

Alkali metal hydroxides have also been found useful as an alkalinity source in the present invention. Alkali metal hydroxides are generally exemplified by species such as potassium hydroxide, sodium hydroxide, lithium hydroxide, and the like. Mixtures of these hydroxide species may also be used. While present, the alkaline hydroxide concentration generally ranges from about 10 wt-% to about 85 wt-%, preferably from about 30 wt-% to 70 wt-%, and most preferably from about 40 wt-% to 60 wt-%.

An additional source of alkalinity includes carbonates. Alkali metal carbonates which may be used in the invention include sodium carbonate, potassium carbonate, sodium or potassium bicarbonate or sesquicarbonate, among others. Preferred carbonates include sodium and potassium carbonates. When carbonates are used the concentration of these agents generally ranges from about 5 wt-% to 70 wt-%, preferably from about 15 wt-% to 55 wt-%, and most preferably from about 30 wt-% to 45 wt-%.

Phosphates which may be used as an alkalinity source in accordance with the invention include cyclic phosphates such as sodium or potassium orthophosphate, alkaline condensed phosphates such as sodium or potassium pyrophosphate, sodium tripolyphosphate, sodium hexametaphosphate, and the like. In using phosphates the concentration will generally range from 5 wt-% to 50 wt-%, preferably from 20 wt-% to 35 wt-%, and most preferably 25 wt-% to 35 wt-%.

B. Sequestrants

In order to prevent the formation of precipitates or other salts, the composition of the present invention generally comprises builders, chelating agents or sequestrants.

Generally, sequestrants are those molecules capable of coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradendate (4), etc. Any number of sequestrants may be used in accordance with the invention. Representative sequestrants include salts of amino carboxylic acids, phosphonic acid salts, water soluble acrylic polymers, among others.

Suitable amino carboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). When used, these amino carboxylic acids are generally present in concentrations ranging from about 1 wt-% to 25 wt-%, preferably from about 5 wt-% to 20 wt-%, and most preferably from about 10 wt-% to 15 wt-%.

Other suitable sequestrants include water soluble acrylic polymers used to condition the wash solutions under end use conditions. Such polymers include polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used.

The weight average molecular weight of the polymers is from about 4000 to about 12,000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.5 wt-% to 20 wt-%, preferably from about 1 to 10, and most preferably from about 1 to 5.

Also useful as sequestrants are phosphonic acids and phosphonic acid salts. Such useful phosphonic acids include, mono, di, tri and tetra-phosphonic acids which can also contain groups capable of forming anions under alkaline conditions such as carboxy, hydroxy, thio and the like. Among these are phosphonic acids having the formula $R_1N[C_2PO_3H_2]_2$ or $R_2C(PO_3H_2)_2OH$, wherein $R_1$ may be -[(lower) alkylene]$N[CH_2PO_3H_2]_2$ or a third $(C_2PO_3H_2)$ moiety; and wherein $R_1$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

When used as a sequestrant in the invention, phosphonic acids or salts are present in a concentration ranging from about 0.25 wt-% to 15 wt-%, preferably from about 1 to 10, and most preferably from about 1 to 5.

C. Solidifying Agent

The invention may also comprise a solidifying agent. Generally, any agent or combination of agents which provides a requisite degree of solidification and aqueous solubility may be used with the invention. A solidification agent may be selected from any organic or inorganic compound which imparts a solid character and/or controls the soluble character of the present composition when placed in an aqueous environment. The solidifying agent may provide for controlled dispensing by using solidification agents which have a relative aqueous solubility. For systems which require less aqueous solubility or a slower rate of dissolution an organic nonionic or amide hardening agent may be appropriate. For a higher degree of aqueous solubility, an inorganic solidification agent or a more soluble organic agent such as urea.

Compositions which may be used with the present invention to vary hardness and solubility include amides such as stearic monoethanolamide, lauric diethanolamide, and stearic diethanolamide.

Amphoteric or zwitterionic surfactants are also useful in providing detergency, emulsification, wetting and conditioning properties. Representative amphoteric surfactants include N-coco-3-aminopropionic acid and acid salts, N-tallow-3-iminodiproprionate salts. As well as N-lauryl-3-iminodiproprionate disodium salt, N-carboxymethyl-N-cocoalkyl-N-dimethylammonium hydroxide, N-carboxymethyl-N-dimethyl-N-(9-octadecenyl)ammonium hydroxide, (1-carboxyheptadecyl)trimethylammonium hydroxide, (1-carboxyundecyl)trimethylammonium hydroxide, N-cocoamidoethyl-N-hydroxyethylglycine sodium salt, N-hydroxyethyl-N-stearamidoglycine sodium salt, N-hydroxyethyl-N-lauramido-β-alanine sodium salt, N-cocoamido-N-hydroxyethyl-β-alanine sodium salt, as well as mixed alicyclic amines, and their ethoxylated and sulfated sodium salts, 2-alkyl-1-carboxymethyl-1-hydroxyethyl-2-imidazolinium hydroxide sodium salt or free acid wherein the alkyl group may be nonyl, undecyl, or heptadecyl. Also useful are 1,1-bis(carboxymethyl)-2-undecyl-2-imidazolinium hydroxide disodium salt and oleic acid-ethylenediamine condensate, propoxylated and sulfated sodium salt. Amine oxide amphoteric surfactants are also useful. This list is by no means exclusive or limiting.

Nonionic surfactants have also been found to impart varying degrees of hardness and solubility when combined with a coupler such as propylene glycol or polyethylene glycol. Nonionics useful in this invention include nonylphenol ethoxylates, linear alkyl alcohol ethoxylates, ethylene oxide/propylene oxide block copolymers such as the Pluronic TM surfactants commercially available from BASF Wyandotte.

Nonionic surfactants particularly desirable as hardeners are those which are solid at room temperature and have an inherently reduced aqueous solubility as a result of the combination with the coupling agent.

Other surfactants which may be used as solidifying agents include anionic surfactants which have high melting points to provide a solid at the temperature of application. Anionic surfactants which have been found most useful include linear alkyl benzene sulfonate surfactants, alcohol sulfates, alcohol ether sulfates, and alpha olefin sulfonates. Generally, linear alkyl benzene sulfonates are preferred for reasons of cost and efficiency.

Other compositions which may be used as hardening agents with the composition of the invention include urea, also known as carbamide, and starches which have been made water soluble through an acid or alkaline treatment. Also useful are various inorganics which either impart solidifying properties to the present composition and can be processed into pressed tablets for carrying the alkaline agent. Such inorganic agents include calcium carbonate, sodium sulfate, sodium bisulfate, alkali metal phosphates, anhydrous sodium acetate and other known hydratable compounds.

Solidifying agents may be used in concentrations which promote solubility and the requisite structural integrity for the given application. Generally, the concentration of solidifying agent ranges from about 5 wt-% to 35 wt, preferably from about 10 wt-% to 25 wt-%, and most preferably from about 15 wt-% to 20 wt-%.

D. Adjuvants

The article of this invention may also comprise any number of formulatory or application based adjuvants such as sanitizers, bleaches, colorants, fragrances, etc.

The detergent composition of the invention may also comprise a bleaching source. Bleaches suitable for use in the detergent composition include any of the well known bleaching agents capable of removing stains from such substrates as dishes, flatware, pots and pans, textiles, countertops, appliances, flooring, etc. without significantly damaging the substrate. These compounds are also capable of providing disinfecting and sanitizing antimicrobial efficacy in certain applications. A nonlimiting list of bleaches include hypochlorites, chlorites, chlorinated phosphates, chloroisocyanates, chloroamines, etc.; and peroxide compounds such as hydrogen peroxide, perborates, percarbonates, etc.

Preferred bleaches include those bleaches which liberate an active halogen species such as $Cl^-$, $Br^-$, $OCl^-$, or $OBr^-$ under conditions normally encountered in typical cleaning processes. Most preferably, the bleaching agent releases $Cl^-$ or $OCl^-$. A nonlimiting list of useful chlorine releasing bleaches includes calcium hypochloride, lithium hypochloride, chlorinated trisodiumphosphate, sodium dichloroisocyanaurate, chlorinated trisodium phosphate, sodium dichloroisocyanurate, potassium dichloroisocyanurate, pentaisocyanurate, trichloromelamine, sulfondichloroamide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof.

Because of their higher activity and higher bleaching efficacies the most preferred bleaching agents are the alkaline metal salts of dichloroisocyanurates and the hydrates thereof.

Generally, when present, the actual concentration of bleach source or agent (in wt-% active) may comprise about 0.5 to 20 wt-%, preferably about 1 to 10 wt-%, and most preferably from about 2 to 8 wt-% of the composition.

The composition of the invention may also comprise a defoaming surfactant useful in warewashing compositions. A defoamer is a chemical compound with a hydrophobe-hydrophile balance suitable for reducing the stability of protein foam. The hydrophobicity can be provided by an oleophilic portion of the molecule. For example, an aromatic alkyl or alkyl group, an oxypropylene unit or oxypropylene chain, or other oxyalkylene functional groups other than oxyethylene provide this hydrophobic character. The hydrophilicity can be provided by oxyethylene units, chains, blocks and/or ester groups. For example, organophosphate esters, salt type groups or salt forming groups all provide hydrophilicity within a defoaming agent.

Typically, defoamers are nonionic organic surface active polymers having hydrophobic groups, blocks or chains and hydrophilic ester groups, blocks, units or chains. However, anionic, cationic and amphoteric defoamers are also known.

Phosphate esters are also suitable for use as defoaming agents. For example, esters of the formula $RO—(PO_3M)—_nR$ wherein n is a number ranging from 1 to about 60, typically less than 10 for cyclic phosphates, M is an alkali metal and R is an organic group or M, with at least one R being an organic group such as an oxyalkylene chain.

Suitable defoaming surfactants include ethylene oxide/propylene oxide blocked nonionic surfactants, fluorocarbons and alkylated phosphate esters.

When present defoaming agents may be present in a concentration ranging from about 0.1 wt-% to 10 wt-%, preferably from about 0.5 wt-% to 6 wt-% and most preferably from about 1 wt-% to 4 wt-% of the composition.

Compositional Form and Shape

The alkaline chemical compositions used in the claimed article may take any number of forms including granular, compressed or cast solid. Granular solids may include any particle solids ranging in diameter from about microns or millimeters in diameter to inches in diameter and preferably from 0.25 inches or less. These granular solids may be formed through any variety of means known to those of skill in the art.

Compressed solids include solids formed by processes such as extrusion, tableting, pelletizing and the like known to those of skill in the art. Compressed solids may range in diameter from fractions of inches or greater and preferably from about 2 inches in diameter. Cast solids are materials which are cast by processes known to those of skill in the art. Cast solids generally comprise a single mass of chemical agent ranging in diameter from about 4 inches to 12 inches, and most preferably from about 6 inches to 8 inches for reasons of economy in use.

Solids used in the invention may be homogeneous or nonhomogeneous. Homogeneous indicates that the solid mass has an even and uniform chemical and physical mixture of constituents. Nonhomogeneous indicates that the solid mass may have an uneven or nonuniform chemical or physical makeup. For example, a nonhomogeneous mass comprises a solid detergent cleaner containing a nonionic surfactant and encapsulated chlorine granules. The incompatibility of the nonionic surfactant and the chlorine generally necessitate the encapsulation of the chlorine which, when mixed in the solid, constitute granules or encapsulates of different chemical composition and physical size than the solid mass in general.

The physical form of the cast and compressed solids may take any general form conducive to dispensing manually or through mechanical or electro-mechanical machine including block, pellet, or granule. If in block form, the invention may take any variety of shapes including cylindrical, conical, cubed or square, hexagonal and the like as can be seen in FIGS. 1–17.

Figure 2:
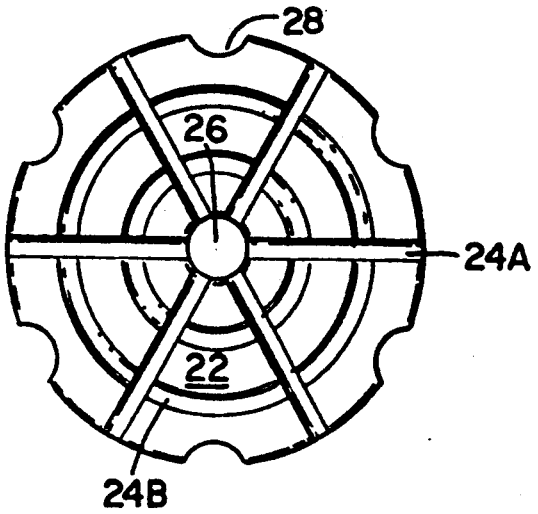
FIG. 2 is a top plan view of the invention shown in FIG. 1.
Figure 3:
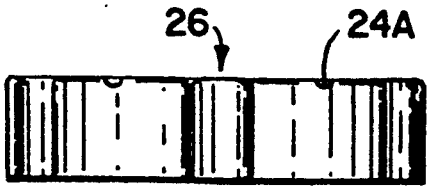
FIG. 3 is a side elevational view of the embodiment of the invention depicted in FIG. 1.

As can be seen in FIGS. 1–3, compressed or cast solid blocks may take the form of a cylinder 20. Generally, the cylinder may be regular in shape or, in the alternative, have any variety of grooved patterns 24A and 24B or inserts 28. These grooves tend to increase the handle ability of the block solid as well as provide for uniform dissolution of the block when exposed to aqueous liquids.

While any number of different groove patterns may be formed, side wall grooves 28, see FIGS. 1–3, function to provide increased handling ability in the chemical block. Increased handling ability is especially important with highly alkaline chemical compositions as these chemicals may provide exposure hazards if not properly handled. Additionally, the upper flat surface 22 of the block may have grooves 24A and 24B formed in any variety of patterns. As can be seen in FIG. 2, grooves 24A may radiate outwardly from the center opening 26 of surface 22, FIG. 2. Additionally, a series of concentric circular grooves 24B may be formed in surface 22. These concentric rings provide additional space in which water may pool leading to the dissolution of the block.

Figure 4:
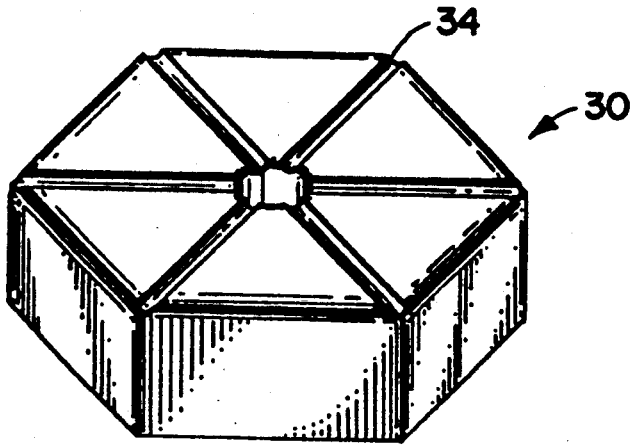
FIG. 4 is a perspective view of an alternative embodiment of the detergent composition of the invention.
Figure 5:
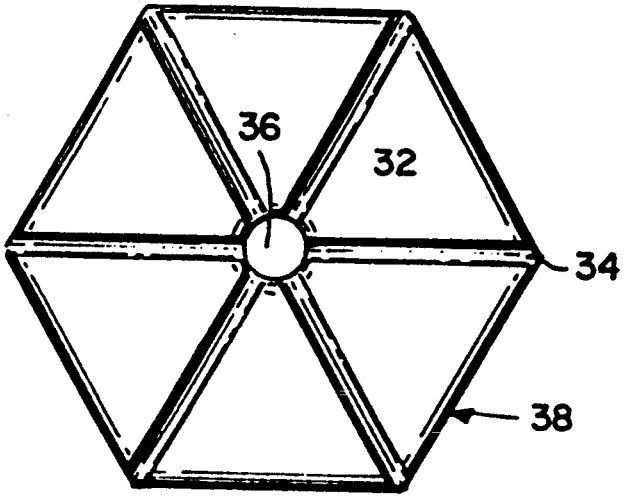
FIG. 5 is a top plan view of the invention shown in FIG. 4.
Figure 6:
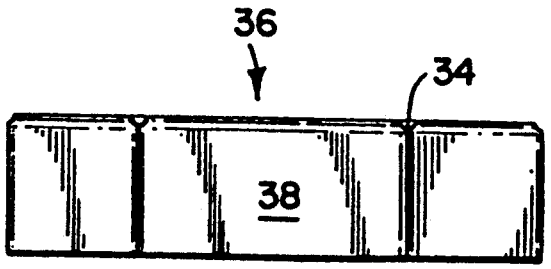
FIG. 6 is a side elevational view of the invention shown in FIG. 4.

As can be seen in FIGS. 4–6, a block of the claimed article may also take a hexagonal shape having six side walls 38 and grooves 34 formed in the upper surface 32 of block 30. In this instance, a central opening 36 is defined in the block to facilitate the passage of aqueous solutions through the center of the block 30 and in turn, dissolution of the chemical composition of the block. FIG. 5 illustrates that the grooves not only facilitate the pooling of water and thus the regular or uniform dissolution of the block but also are capable of providing any variety of aesthetic patterns or shapes in the block.

Figure 7:
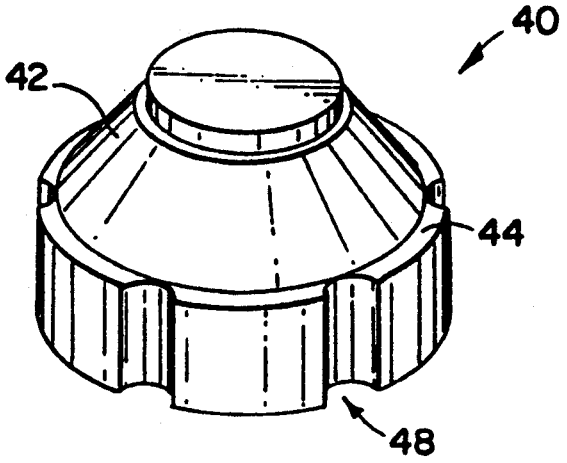
FIG. 7 is a further alternative embodiment of the detergent composition of the invention.
Figure 8:
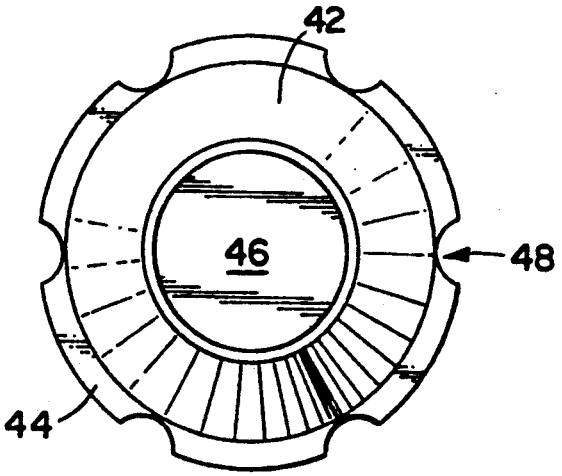
FIG. 8 is a top elevational view of the detergent composition shown in FIG. 7.
Figure 9:
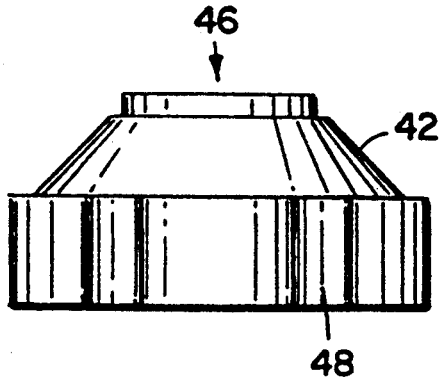
FIG. 9 is a side elevational view of the detergent composition of the invention shown in FIG. 7.

Turning to FIGS. 7–9, the block 40 may also take a cylindrical shape having a conically projecting surface 42, FIGS. 1 and 3. In this embodiment, the cylindrical side wall of the block has again retained grooves 48 which facilitate one's ability to handle the block. Conical surface 42 comes to a flat face surface 46 which is capable of providing direct contact with a spray mist. The shape of FIGS. 7–9 illustrates the ability of the article of the present invention to adopt any number of forms which have aesthetic appeal.

Additionally, the shape of FIGS. 7–9 illustrates that the solid blocks may be designed and formed to fit any number of dispensing units, allowing for the integration of a specific product shape with a specific unit intended for a given application. For example, chemical compositions intended for warewashing operations would have that specific product design. In contrast, chemical products not intended for warewashing operations would retain another design unlike that of the warewashing compositions.

Figure 10:
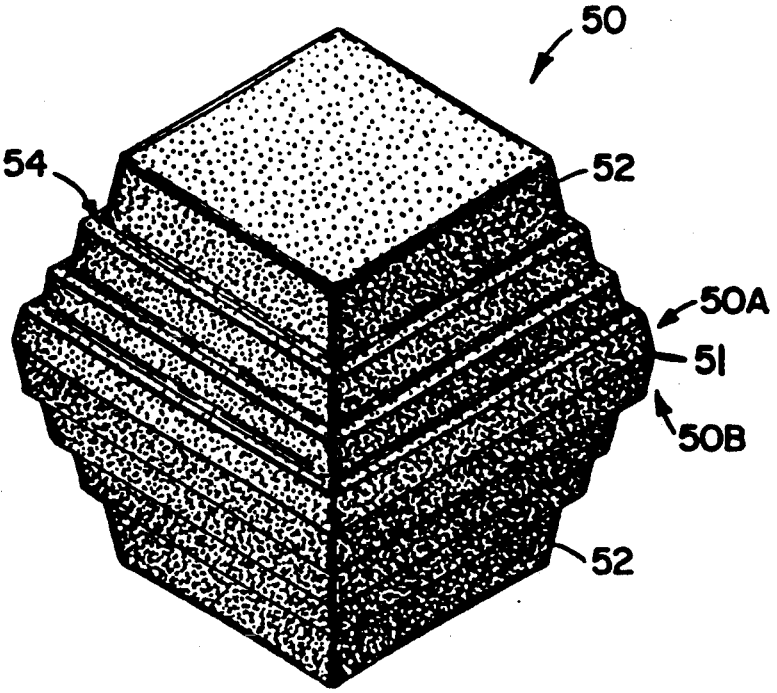
FIG. 10 is a perspective view of another further alternative embodiment of the detergent composition of the present invention.
Figure 11:
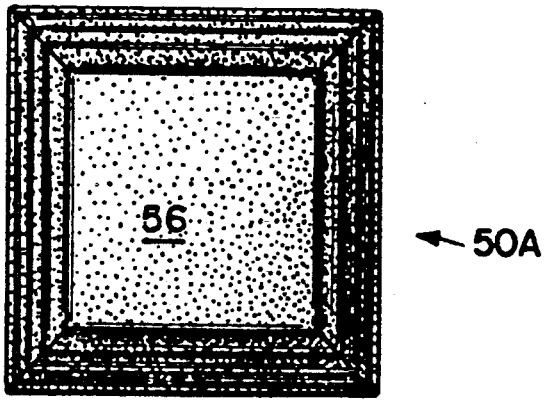
FIG. 11 is a top elevational view of the embodiment of the invention shown in FIG. 10.
Figure 12:
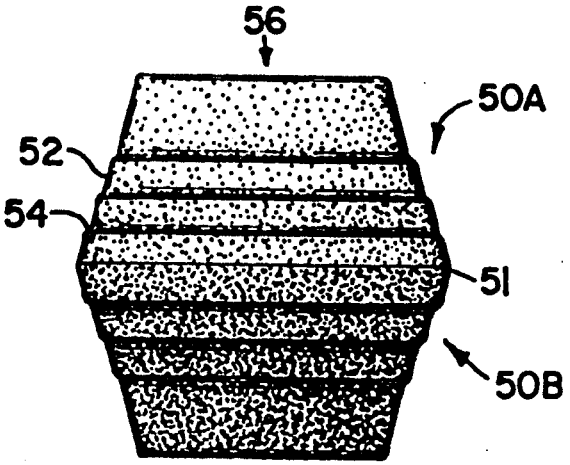
FIG. 12 is a side elevational view of the invention shown in FIG. 10.

Another aspect of the claimed invention can be seen in FIGS. 10–12. In this instance, the cast or compressed solid block may be formed as a single piece or as multiple pieces. Specifically, block 50 presents one embodiment of a article which may be used to dispense two incompatible chemical compositions. As can be seen in FIG. 10, line 51 may represent a point of separation between autonomous block 50A and 50B.

In instances where block 50A and block 50B each comprise different chemical compositions which are not compatible when placed adjacent one another, separation point 51 may house an inert liner (not shown) which is held in place between two blocks during preparation and storage. Insert liners which may be used may be soluble or insoluble, organic or inorganic depending upon the chemistry of the alkaline composition. Once applied, the inert liner may be removed to allow the intermixing of the chemicals towards the final use application.

Additionally, the liner used may be inert to the chemical compositions of block 50A and 50B but retain a certain degree of aqueous solubility so that application of the blocks to any dispenser will not require removal of the liner from between the blocks. The mere application of an aqueous diluent to the article will allow the liner to be solubilized and the chemicals of block 50A and 50B to contact and be intermixed.

This embodiment of the invention also comprises steps, 52 and 54. These steps provide greater surface area in the formed block and also allow for uniform dissolution of the block once contacted with a diluent.

FIGS. 13–17 show an additional embodiment of the invention. Specifically, FIG. 13 is a perspective view of the claimed composition in the form of a regular square or rectangular block 60. As can be seen, the upper surface 62 has formed therein grooves to allow for the pooling of water and solubilization of the chemical agent. As can be seen in FIGS. 14 and 15 these grooves may be formed in the block to coincide with the block side 68 or to run parallel to the block side 68 (FIG. 15). Generally, the bottom of the block 65 may be patterned or unpatterned as seen in FIG. 17.

Any number of shapes may be defined in the disclosed article to assist in manual or dispenser dissolution of the composition. Further, the article of the invention may be dispensed by simple submersion in water or through a mechanical dispenser such as a Universal Reservoir Dispenser sold by Ecolab, St. Paul, Minn.

The Polymeric Films

The alkaline cleaning article of the present invention also comprises a continuous polymeric film. The films of the invention have at least three general functions or properties. First, the disclosed films remain stable even though used with highly alkaline chemical compositions. In this instance, stability means that the films will not chemically or mechanically degrade or erode over time when placed in storage even though in contact with highly alkaline solid materials. Further, the film must remain aqueous soluble or dispersible after extended contact with alkaline chemicals.

An additional function of the polymeric film of the present invention is strength. Specifically, films used in accordance with the invention must have sufficient tensile strength to allow their use in the packaging of solid block, granular, compressed or pelletized chemical agents. The polymeric films of the invention should have sufficient strength to allow storage and transport after packaging so that the alkaline chemical agent is contained within a package of adequate structural integrity.

The films of the present invention preferably provide enough tolerance to humid, temperate environments to prevent degradation of the film exposure of the highly alkaline material to packagers, transporters, or operators in the use of the chemical composition. Yet the films remain soluble or dispersible when exposed to water of the appropriate temperature.

Keeping these general functions in mind, any aqueous soluble or dispersible polymeric film may be used which provide adequate stability, strength, and aqueous tolerance in accordance with this invention. However, certain vinyl monomers, polymers, copolymers, and polymeric mixtures have been found especially preferable including vinyl alcohol polymers, polymers resulting from alpha, beta unsaturated carboxylic acid monomers, polymers resulting from alkyl or aliphatic esters of alpha, beta unsaturated carboxylic ester monomers, oxyalkylene polymers and copolymers.

A. Polyvinyl Alcohols and Acetates

Polymeric vinyl alcohol or polyvinyl alcohol (PVOH), is a polyhydroxy polymer having a polymethylene backbone with pendent hydroxy groups. PVOH is a water soluble synthetic resin. It is produced by the hydrolysis of polyvinyl acetate. The theoretical monomer $$\begin{array}{c} CH_2{=}CH \\ | \\ OH \end{array}$$

does not exist. Polyvinyl alcohol is one of the very few high molecular weight commercial polymers that may be water soluble or dispersible. It is commonly available as a dry solid and is available in granular or powder form. PVOH grades include a "super" hydrolyzed form (99.3 wt-%+removal of the acetate groups), a fully hydrolyzed form (99 wt-%+removal of the acetate groups), a form of intermediate hydrolysis (about 98 to 91 wt-% removal of the acetate groups), and partially hydrolyzed (about 91 to 85 wt-% removal of the acetate groups) polyvinyl alcohol.

The properties of the resins vary according to the molecular weight of the parent polymer and the degree of hydrolysis. Polyvinyl alcohols are commonly produced in nominal number average molecular weights that range from about 20,000 to about 200,000. Commonly, the molecular weight of the commercial polyvinyl alcohol grades is reflected in the viscosity of a 4 wt-% solution measured in centipoise (cP) at 20° C. with a Brookfield viscometer. The viscosity of a 4 wt-% solution can range from about 5 to about 65 cP. Variation in film flexibility, water sensitivity, ease of solvation, viscosity, block resistance, adhesive strength, dispersing power, can all be varied by adjusting the molecular weight or degree of hydrolysis.

Solutions of polyvinyl alcohol in water can be made with large quantities of lower alcoholic cosolvents and salt cosolutes. Polyvinyl alcohol can react with aldehydes to form acetals, can be reacted with acrylonitrile to form cyanoethyl groups, and can be reacted with ethylene and propylene oxide to form hydroxy alkaline groups. Polyvinyl alcohols can be readily crosslinked and can be borated to effect gelation.

Polyvinyl alcohol is made by first forming polyvinyl acetate or vinyl acetate containing copolymer such as an ethylene vinyl acetate copolymer and removing the acetate groups using a base catalyzed alkanolysis. The production of polyvinyl acetate or a vinyl acetate copolymer can be done by conventional processes which control the ultimate molecular weight. Catalyst selection, temperatures, solvent selection and chain transfer agents can be used by persons skilled in the art to control molecular weight. The degree of hydrolysis is controlled by preventing the completion of the alkanolysis reaction.

B. Unsaturated Carboxylic Acids and Esters

The polymeric films of the invention may also result from the polymerization or copolymerization of monomeric alpha, beta unsaturated carboxylic acid or monomeric esters of alpha, beta unsaturated carboxylic acid. Suitable monomers include those containing a carboxylic acid or carboxylate group as a functional group and include a vinyl monomer having a free carboxylic acid or carboxylate functional group.

Preferred carboxylic acid containing monomers comprises alpha, beta unsaturated carboxylic acids including methacrylic acid, acrylic acid, itaconic acid, iconatic acid, cinnamic acid, crotonic acid, mesaconic acid, carboxyethyl acrylic acid, maleic acid, fumaric acid, and the like.

Also useful in the synthesis of an acrylic copolymeric film useful in this invention include esters of alpha, beta unsaturated carboxylic acid such as those mentioned above.

The alkyl esters may be selected from higher alkyl esters such as those of about 5–22 carbon atoms. Examples of $C_{5-22}$ compounds include hexyl, octyl, ethyl (hexyl), isodecyl, and lauryl, acrylates, and methacrylates and itaconates. Alkyl esters having branched as opposed to straight chain moieties are also useful in the present copolymers.

Polymer films resulting from these monomers can be prepared by carrying out the polymerization of the mixture of monomer and solvent or solvent mixture such as those processes known to those of skill in the art.

C. Ethylene Resins

An additional family of monomers which has been found useful in producing the copolymer film of the present invention are polymeric ethylene oxide resins. Generally ethylene oxide has the formula:

$$H(OCH_2CH_2)_nOH.$$

Polyethylene oxides are generally clear viscous liquids, or depending on molecular weight and moles of ethylene oxide, white solids which dissolve in water, forming transparent solutions. Polyethylene oxide is soluble in many organic solvents and readily soluble in aromatic hydrocarbons while only slightly soluble in aliphatic hydrocarbons. Polyethylene oxides are generally classified not only by moles of ethylene oxide present within the composition, but also by molecular weight.

D. Preferred Films

In preparing the polymeric film of the present invention, we have found that certain polymers, and polymeric blends are especially preferable. Generally, the polymeric film of the present invention may be single layer or multi-layer. If single layer, the film of the invention most preferably comprises ethyl acrylate-acrylic acid copolymer such as Belland resins 2620 and the like.

If multi-layer, the polymeric film of the invention may have any variety of constituencies depending upon the given application. Generally, the most preferred films are two layer and three layer films. Both two and three layer films made in accordance with this invention have an inner layer which is alkali stable.

i. The Inner Layer

Preferably, this alkali stable inner layer comprises a copolymer of monomeric alpha, beta unsaturated carboxylic acid and monomeric alkyl esters of an alpha, beta unsaturated carboxylic acid.

This copolymeric blend provides stability in high pH environments allowing extended storage prior to use without operator exposure to the highly alkaline material through the package. Additionally, this copolymer does not break down or degrade so as to become nonaqueous soluble or dispersible. The most preferred film is one made from an acrylic acid-ethyl acrylate copolymer. Preferred resins include the commercially Bellund and resin such as 2620 which provides heightened caustic stability.

The inner alkali stable layer may also preferably comprise a polymeric mixture of polyvinyl alcohol and polyoxyethylene.

Partially hydrolyzed polyvinyl alcohol has been found to be the most useful in this polymeric mixture having a level of hydrolysis ranging from 80 wt-% to 90 wt-%, preferably from about 83 wt-% to 89 wt-%, and most preferably from about 87 wt-% to 89 wt-% such as Air Products Vinex® 2034 or 2134 resins of partially hydrolyzed polyvinyl alcohol.

The other constituent of this polymeric blend may generally comprise polyoxyethylene. Generally, polyoxyethylene useful in this aspect of the invention include those sold by Union Carbide such as Polyox® WRPA 3154.

These ranges have been found to provide the highest degree of alkaline stability along with maximum tensile strength in this inner layer of the multi-layer polymeric film.

ii. The Intermediate Layer

The intermediate layer of a multi-layer film has most preferably been found to comprise a partially hydrolyzed polyvinyl alcohol. This layer is intended to provide the multi-layer polymeric film with suitable tensile strength so that the film may withstand processing stresses and those physical stresses encountered in transport and application of the article. Generally, the level of hydrolysis in the partially hydrolyzed polyvinyl alcohol will range from about 80 wt-% to 90 wt-%, preferably from about 83 wt-% to 89 wt-%, and most preferably from about 87 wt-% to 89 wt-%.

iii. The Outer Layer

Applicants have also found that the optional application of an outer layer comprising polyvinyl alcohol having a level of hydrolysis of at least 95 wt-% and generally ranging from 96 wt-% to 99.5 wt-%, preferably from about 97 wt-% to 99 wt-%, and most preferably from about 98 wt-% to 99 wt-% provides the most suitable protection from premature dissolution of the film due to ambient moisture or cold water.

Preferred films include those made from Air Products resins such as Vinex® 1003. Also prevented is exposure of the highly alkaline material to operators, transporters, or packagers. As a result, the disclosed three-ply film is stable in alkaline environments for extended periods of time, retains aqueous solubility after extended exposure to high pH compositions, and remains aqueous insoluble in the face of environmental stresses such as high humidity, high temperature and inadvertent cold water exposure.

This differential solubility provides broad compositional applicability. Depending on whether the resulting film is single ply or multi ply the solubilization temperature may range from about 140° F. to 180° F., preferably from about 140° F. to 160° F. and more preferably from about 140° F. to 150° F. for multiple layer films. For single layer films dissolution temperatures generally range from about 100° F. to 140° F., preferably from about 100° F. to 130° F. and most preferably from about 100° F. to 120° F.

In two layer articles the polymeric film may have an inner layer comprising an ethyl acetate-acrylic acid copolymer or a polymer mixture of polyoxyalkylenes and polyvinyl alcohol as disclosed above. The intermediate layer would be omitted from this article and an outer layer of highly hydrolyzed polyvinyl alcohol to provide mechanical strength and stability as well as resistance to cold water dissolution or dispersion.

E. Article Fabrication

Films used with the article of the invention may be formed around the cleaning detergents through any variety of means known to those of skill in the art. Processes useful in forming the polymeric film include melt forming processes such as calendaring or extrusion including blown bubble, slot dye casting, and coating on a substrate; solution forming chemical regeneration methods, emulsion forming, and powder forming.

Generally, preferred methods of forming the film over the solid include co-casting, coextrusion, extrusion laminating, and blown extrusion. The resulting films generally have a thickness which prior to stretching may vary considerably. Once stretched film thickness preferably ranges from about 1 mil. to about 15 mil., preferably from about 1 mil. to 6 mil., and most preferably from about 1 mil. to 3 mil. These film thicknesses have been found to provide the best protection to operator and handler along with providing optimal solubility when placed in their use application.

EXAMPLES

Following below are formulatory, stability, and application examples using the composition of the invention. While the invention is exemplified by the working examples, it is not limited to the examples shown hereinafter.

COMPARATIVE EXAMPLE 1

A control of alkali pellets (100 wt-% NaOH) were packaged (1 lb.), stored, and dispenses in a monolayer Vinex 4025® film (partially hydrolyzed PVOH) supplied by Air Products. These bags were dispensed using a dispenser commonly available in the market (Universal Reservoir Dispenser from Ecolab Inc.). Upon dispensing, no residual film remained in the presence of alkali at 130° F. However, the film became unacceptably brittle after storage with the product at room temperature.

COMPARATIVE EXAMPLE 2

An alkaline composition generally comprising 27.7 wt-% of sodium tripolyphosphate, 10 wt-% dense ash, 9 wt-% NaCl, 2 wt-% sodium polyacrylate builder, 0.3 wt-% defoamer, 4 wt-% chlorine source in the form of an isocyanurate, and 40 wt-% sodium hydroxide, was then packaged in a film having an outer layer of fully hydrolyzed polyvinyl alcohol and an inner layer partially hydrolyzed polyvinyl alcohol. The resulting compositions comprise bags of roughly 500 grams alkaline product. The bags were then placed into a dispenser (Universal Universal Reservoir Dispenser from Ecolab Inc.) having a No. 16 mesh flat support screen with 1¾ inch ring spacer. The dispenser also had a powder screen with No. 24 mesh which concaved downward. During dispensing, the water pressure was applied at 20 psi through a 5.6 gauge nozzle. The nozzle extension was 1¾ inch from the product and it applied 140° .F water. The packaged alkaline material was then dispensed under the conditions detailed above. After dispensing, about 11 grams of residue remained in the dispenser. This was clearly an unacceptable amount of residue resulting from exposure of the polymeric bag to the caustic material.

COMPARATIVE EXAMPLE 3

The same composition used in Comparative Example 2 was then packaged in a bag comprising an inner layer of acrylic acid/ethylacrylate copolymer, a median layer of partially hydrolyzed polyvinyl alcohol, and an outer layer of fully hydrolyzed polyvinyl alcohol. During storage, one bag of the product split exposing both sides of the three other bags to the caustic products. However, the three remaining bags of the product provided adequate sealing against the caustic product.

The bags of highly alkaline material were then introduced into the dispenser used in Comparative Example 2 and under the same conditions. After dispensing, about 3 grams of residue remained.

COMPARATIVE EXAMPLE 4

An additional set of bags was prepared by using the composition prepared in Comparative Example 2 and the film of Comparative Example 3. However, the film was reversed resulting in the fully hydrolyzed layer on the inside of the package and the ethylacrylate/acrylic acid copolymer on the exterior of the package. Application of these bags to a dispenser as disclosed in Comparative Example 2 resulted in about 6 grams of residue.

WORKING EXAMPLE 1

A block of alkaline chemical concentrate comprising, among other constituents, 45 wt-% caustic and 35 wt-% sodium tripolyphosphate was then packaged in the film used in Comparative Example 3. After packaging, the block was placed in a warewashing detergent dispenser (Universal Reservoir, Ecolab Inc.) and dispensed with 140° F. water under similar conditions to those disclosed in Comparative Example 2. After dispensing, about 1 gram of residue remained. Additional runs of the same composition in the same film are shown below in Table 1 illustrating the water temperature, the time of water application, and the resulting residue.

TABLE 1

| Working Example | Water Temperature | Time of Water Application | Resulting Residue |
|---|---|---|---|
| 1A | 175° F. | 4 min. | Negligible |
| 1B | 140° F. | 4 min. | Negligible |
| 1C | 140–175° F. | 4 min. | Negligible |

WORKING EXAMPLES 2–6

For Working Examples 2–6 the following Treatment Codes apply:

| | |
|---|---|
| CODE: | C = Stored at Room Temperature |
| | D = Stored at Room Temperature with 0 wt-% Relative Humidity |
| | E = Stored at 100 F. with 50 wt-% Relative Humidity |
| | G = Article Additionally Wrapped in a Water Insoluble Vapor Barrier |

As indicated by the codes, a multilayer film having an inner layer of ethylacrylate/acrylic acid copolymer, an intermediate layer of partially hydrolyzed polyvinyl alcohol, and an outer layer of fully hydrolyzed polyvinyl alcohol was stored under varying conditions.

WORKING EXAMPLE 2

Extruded caustic (84 wt-% sodium hydroxide and 10 wt-% $H_2O$) ropes or pellets were then prepared and treated and stored as indicated below. Provided below is a summary of results for given treatment and storage conditions.

| Working Example | Treatment | Storage Time | Comments |
|---|---|---|---|
| 2A | C | 28 Days | OK |
| 2B | CG | 28 Days | OK |
| 2C | E | 28 Days | OK |
| 1D | EG | 24 Days | Bag Split Failed |

WORKING EXAMPLE 3

An alkaline warewashing detergent was then formulated generally comprising the following constituents:

| (Wt-%) | Constituent |
|---|---|
| 15.3 | Sodium Hydroxide (50 wt-% W/V) |

-continued

| (Wt-%) | Constituent |
|---|---|
| 0.5 | Sodium Chlorite Solution (25 wt-%) |
| 2.5 | Soft Water |
| 0.5 | Surfactant |
| 2.0 | Sodium Polyacrylate (50 wt-%) |
| 37.9 | Sodium Hydroxide, Beads (100 wt-% NaOH) |
| 3.0 | Benzylether of a Polyethoxylated Linear Alcohol (12 Moles of ethylene oxide) |
| 2.0 | Sodium Polyacrylate |
| 35.5 | Sodium Tripolyphosphate |

Once this formulation was completed, it was inserted into two layer and three layer bag articles generally comprising ethylacrylate/acrylic acid copolymer as an inner layer, a polyvinyl alcohol intermediate layer having a partial level of hydrolysis, and an outer layer of fully hydrolyzed polyvinyl alcohol. Stability date is reported below.

| Working Example | Treatment | Storage Time |
|---|---|---|
| 3A | C | 33 Days |
| 3B | C | 24 Days |
| 3C | C | 14 Days |
| 3D | C | 24 Day |
| 3E | C | 28 Days |
| 3F | CG | 24 Day |
| 3G | CG | 24 Days |
| 3H | CG | 24 Days |
| 3I | CG | 43 Days/OK |
| 3J | CG | 43 Days/OK |
| 3K | E | 7 Days |
| 3L | E | 7 Days |
| 3M | E | 7 Days |
| 3N | E | 7 Days |
| 3O | E | 7 Days |
| 3P | EG | 9 Days |
| 3Q | EG | 9 Days |
| 3R | EG | 9 Days |
| 3S | EG | 9 Days |
| 3T | EG | 9 Days |

After the time stored Examples 3A–3H and 3K–3T showed detectable alkalinity on the exterior surface of the film. Examples 3I and 3J showed no detectable alkalinity on the exterior surface of the film. Storage times may be increased by allowing the composition to equilibrate prior to being packaged in the film.

WORKING EXAMPLE 4

The formulation of Working Example 3 was then reprocessed and remixed under heated conditions (about 150° F.) and used in additional bags under the disclosed treatment conditions and the results are reported below.

| Working Example | Treatment | Storage Days |
|---|---|---|
| 4A | C | 33 Days/Spotting |
| 4B | C | 33 Days/OK |
| 4C | C | 33 Days/OK |
| 4D | C | 33 Days/OK |
| 4E | CG | 33 Days/OK |
| 4F | CG | 33 Days/OK |
| 4G | CG | 33 Days/OK |
| 4H | CG | 33 Days/Spotting |
| 4I | E | 11 Days |
| 4J | E | 23 Days |
| 4K | E | 33 Days/Spotting |
| 4L | E | 30 Days |
| 4M | EG | 33 Days/OK |
| 4N | EG | 33 Days/OK |
| 4O | EG | 33 Days/Spotting |

-continued

| Working Example | Treatment | Storage Days |
|---|---|---|
| 4P | EG | 33 Days/OK |

Examples 4B–4G, 4M, 4N, and 4P all showed no detectable alkalinity on the outside surface of the film.

WORKING EXAMPLE 5

Another alkaline product was then formulated having the following constituents:

| Percent | Raw Material |
|---|---|
| 34.0 | Sodium Tripolyphosphate |
| 10.0 | Dense Ash |
| 9.0 | NaCl |
| 2.0 | Sodium polyacrylate |
| 4.0 | Sodium Dichloroisocyanurate Dihydrate |
| 40.0 | NaOH (100 wt-%) |
| 1.0 | Surfactant defoamer |

After formulation, composition was packaged in the three layer film used in Working Example 2 and subjected to storage conditions detailed below.

| Working Example | Treatment | Storage Days |
|---|---|---|
| 5A | C | 27 Days |
| 5B | C | 41 Days/OK |
| 5C | C | 41 Days/OK |
| 5D | C | 41 Days |
| 5E | C | 41 Days/OK |
| 5F | CG | 41 Days/OK |
| 5G | CG | 41 Days/OK |
| 5H | CG | 41 Days/OK |
| 5I | CG | 41 Days/OK |
| 5J | CG | 41 Days |
| 5K | E | 41 Days/OK |
| 5L | E | 28 Days |
| 5M | E | 41 Days/OK |
| 5N | E | 41 Days/OK |
| 5O | E | 41 Days/OK |
| 5P | EG | 41 Days/OK |
| 5Q | EG | 41 Days/OK |
| 5R | EG | 41 Days/OK |
| 5S | EG | 41 Days/OK |
| 5T | EG | 41 Days/OK |

The anhydrous powder article used in Examples 5A–5T provided no detectable alkalinity on the exterior surface of the film in the majority of the Examples after 41 days.

WORKING EXAMPLE 6

An analysis of various alkaline compositions is then undertaken as measured against a control. The control composition was 100 wt-% caustic bead composition (NaOH 100 wt-%) wrapped in a partially hydrolyzed polyvinyl alcohol film. As can be seen in the Table provided below, this outer wrap caustic composition failed after three days.

Working Examples 6A through 6M were then prepared. In each of the Examples, the varying compositions were wrapped in a three layer film comprising an inner layer of ethylacrylate/acrylic acid copolymer, a median layer of partially hydrolyzed polyvinyl alcohol, and an outer layer of fully hydrolyzed polyvinyl alcohol.

| Composition Control* | Treatment | Storage Stability |
|---|---|---|
| (100 wt-% Caustic Bead) | C | 3 Days |
| 6A (Encapsulated 100 wt-% Caustic Bead) | C | 60 Days/OK |
| 6B (100 wt-% Caustic) | C | 10 Days |
| 6C (40 wt-% Caustic/ 25 wt-% Sodium Tripolyphosphate | C | 15 Days |
| 6D (40 wt-% Caustic/ 25 wt-% Sodium Tripolyphosphate) | C | 32 Days |
| 6E (37 wt-% Caustic With Ash (30 wt-%) and Sodium Tripolyphosphate (29 wt-%)) | C | 61 Days |
| 6F (37 wt-% Caustic With 30 wt-% NaCl and 29 wt-% Sodium Tripolyphosphate) | C | 60 Days./OK |
| 6G (37 wt-% NaOH, With 29 wt-% NaCl and 30 wt-% Ash) | C | 60 Days/OK |
| 6H (37 wt-% NaOH 59 wt-% NaCl) | C | 60 Days/OK |
| 6I (Working Example 6E Formula With 2 wt-% (w/w) $H_2O$ in Bag) | C | 47 Days/OK |
| 6J (Working Example 6E Formula With 4 wt-% (w/w) $H_2O$ in Bag) | C | 34 Days |
| 6K (Working Example 6E Formula With 6 wt-% (w/w) $H_2O$ in Bag) | C | 3 Days |
| 6L (Working Example 6E Formula With 10 wt-% (w/w) $H_2O$ in Bag) | C | 3 Days |

*Wrapped in partially hydrolyzed monolayer, CrisCraft Mono-Sol M7030.

The control failed after 3 days. Examples 6A–6H showed stability extending in certain cases beyond 60 days. Examples 6I–6L demonstrated stability equivalent or superior to the control with up to 10 wt-% $H_2O$ present in the film.

The above specification, examples and data provided complete description of the manufacture and use of the article of the invention. Since many embodiments of the invention can be made without departing from the spirit and scope of the invention, the invention resides in the claims hereinafter appended.

We claim as our invention:

1. A multidose alkaline cleaning article comprising:

(a) a solid detergent composition having a pH greater than 10.5 when diluted to a 1 wt-% aqueous solution said detergent comprising a source of alkalinity, said alkalinity source selected from the group consisting of a silicate, an alkali metal hydroxide, a phosphate, a carbonate, and mixtures thereof; and (b) a continuous multilayer polymeric film, dispersible or soluble in aqueous liquids, covering the solid detergent composition, said multilayer film comprising an inner alkaline pH stable and aqueous soluble film and an outer layer resistant to aqueous dissolution and effective in providing mechanical strength wherein said multilayer film remains mechanically stable and aqueous soluble or dispersible after exposure to the solid detergent composition.

2. The article of claim 1 wherein said polymeric film covers substantially the entirety of the solid detergent composition.

3. The article of claim 1 wherein said continuous polymeric film comprises a vinyl polymer.

4. The article of claim 1 wherein said polymeric film comprises two or more layers.

5. The article of claim 4 wherein said inner layer and said outer layer are joined by a plurality of randomly distributed film to film bonds.

6. The article of claim 4 wherein said inner layer and said outer layer are joined by coextensive layer to layer lamination.

7. The article of claim 4 wherein said continuous polymeric film comprises an inner alkali stable and aqueous soluble layer, an outer cold water resistant layer, and an intermediate structural layer.

8. The article of claim 1 wherein said polymeric film has a thickness ranging from about 0.6 mil to about 15 mil.

9. The article of claim 1 wherein said hydroxide is selected from the group consisting of sodium hydroxide, potassium hydroxide, and mixtures thereof.

10. The article of claim 9 wherein said alkaline agent comprises sodium hydroxide present at a concentration ranging from about 5 wt-% to about 80 wt-%.

11. The article of claim 1, wherein said alkaline agent comprises a silicate present at a concentration ranging from about 5 wt-% to 80 wt-%.

12. The article of claim 1, wherein said alkaline detergent composition comprises a granular solid.

13. The article of claim 12 wherein said granular solid is contained within said continuous polymeric film and said granular solid is formed into a rigid shaped block, said shape selected from the group consisting of a cubed block, a hexagonal block, a cylindrical block, and a block comprising a cylindrical body and a conical surface.

14. The article of claim 1, wherein said alkaline detergent composition comprises a compressed solid block.

15. The article of claim 1, wherein said alkaline detergent composition comprises a solid block having a mass of at least 800 grams.

16. The article of claim 15 wherein said solid block comprises a shape said shape selected from the group consisting of a cylindrical block, a hexagonal block, a cube, and a cylindrical block comprising a conical surface.

17. The article of claim 15 wherein said solid block comprises a grooved side wall.

18. The article of claim 16 wherein said block comprises a flat surface having grooves.

19. The article of claim 18 wherein said grooves project radially outward across the flat surface.

20. The article of claim 18 wherein said flat surface is circular in shape and comprises a first set of grooves projecting radially outward from the center of the surface and a second set of groves positioned concentrically in relationship to the center of the flat surface wherein said first set of groves and said second set of grooves intersect.

21. A multidose alkaline cleaning article comprising:

(a) a solid detergent composition comprising from about 5 wt-% to 80 wt-% of an alkalinity source and having a pH greater than 10.5 when diluted to a 1 wt-% aqueous solution said detergent comprising a source of alkalinity, said alkalinity source selected from the group consisting of a silicate, an alkali metal hydroxide, a phosphate, a carbonate, and mixtures thereof; and (b) a continuous multilayer polymeric film having at least a first inner alkaline stable and aqueous soluble layer and a second outer layer resistant to aqueous dissolution and effective in providing mechanical strength, said film is soluble or dispersible in aqueous liquids and covers the solid detergent composition wherein said film remains aqueous soluble or dispersible and mechanically stable after extended exposure to the solid alkaline detergent.

22. The article of claim 21 wherein said polymeric film covers substantially the entirety of the solid detergent composition.

23. The article of claim 21 wherein said continuous polymeric film has a thickness ranging from about 0.6 mil to 15 mil.

24. The article of claim 21 wherein said inner layer and said outer layer are jointed by a plurality of randomly distributed film to film bonds.

25. The article of claim 21 wherein said inner layer and said outer layer are joined by coextensive layer to layer lamination.

26. The article of claim 20 wherein said continuous polymeric film comprises an inner alkali resistant layer, an outer cold water resistant layer, and an intermediate structural layer.

27. The article of claim 21 wherein said hydroxide is selected from the group consisting of sodium hydroxide, potassium hydroxide, and mixtures thereof.

28. The article of claim 27 wherein said pH ranges from about 11.5 to about 12.5.

29. The article of claim 21, wherein said alkaline detergent composition comprises a granular solid.

30. The article of claim 29 wherein said granular solid is contained within said continuous polymeric film and formed into a rigid shaped block, said shape selected from the group consisting of a cubed block, a hexagonal block, a cylindrical block, and a cylindrical block comprising a conical surface.

31. The article of claim 21, wherein said alkaline detergent composition comprises a compressed solid.

32. The article of claim 21, wherein said alkaline detergent composition comprises a solid block having a mass of at least 800 grams.

33. The article of claim 32 wherein said solid block comprises a shape said shape selected from the group consisting of a cylindrical block, a hexagonal block, a cube, and a cylindrical block having a conical surface.

34. The article of claim 32 wherein said solid block comprises a grooved side wall.

35. The article of claim 34 wherein said block comprises at least one flat surface having grooves.

36. The article of claim 35 wherein said grooves project radially outward across the flat surface.

37. The article of claim 36 wherein said flat surface is circular in shape and comprises a first set of grooves projecting radially outward from the center of the surface and a second set of grooves concentrically positioned in relationship to the center of the flat surface wherein said first set of grooves and said second set of grooves intersect.

38. The alkaline detergent composition of claim 21 comprising:

(a) a detergent composition comprising:

(i) at least 30 wt-% of an alkaline hydratable chemical said detergent comprising a source of alkalinity, said alkalinity source selected from the group consisting of a silicate, an alkali metal hydroxide, a phosphate, a carbonate, and mixtures thereof;

(ii) an effective amount of hardness sequestering agent;

(iii) water of hydration, at least a portion of said water of hydration being associated with said alkalinity source wherein the alkalinity source and the hardness sequestering agent are present in amounts sufficient to render the detergent solid; and (b) a multilayer polymeric film covering the detergent composition, said film comprising an inner layer comprising an alkaline stable and aqueous soluble layer, an intermediate layer comprising a layer providing mechanical stability and the outer layer comprising a film that can remain non-tacky and intact when contacted with cold water.

39. The article of claim 38 wherein said hardness sequestering agent is selected from the group consisting of an alkali metal tripolyphosphate salt, a polyacrylic acid or salt thereof, a phosphonic acid or salt thereof, an aminocarboxylic acid or salt thereof, a polycarboxylic acid or salt thereof, and mixtures thereof.

40. The article of claim 38 additionally comprising a surfactant.

41. The article of claim 38 wherein said alkaline source comprises from about 30 wt-% to about 60 wt-% of the composition.

42. The article of claim 38 comprising from about 5 wt-% to 20 wt-% of a chlorine source.

43. A method of using a multidose alkaline cleaning article comprising:

(a) a solid detergent composition having a pH greater than 10.5 when diluted to a 1 wt-% aqueous solution said detergent comprising a source of alkalinity, said alkalinity source selected from the group consisting of a silicate, an alkali metal hydroxide, a phosphate, a carbonate, and mixtures thereof; and (b) a continuous multilayer polymeric film, dispersible or soluble in aqueous liquids, said multilayer film covering the solid detergent composition and multilayer film comprising an inner alkali pH stable and aqueous soluble film and an outer layer resistant to aqueous dissolution and effective in providing mechanical strength wherein said film remains aqueous soluble or dispersible and mechanically stable after exposure to the solid alkaline detergent, said method comprising the step of applying water to said article to dissolve or disperse a portion of said polymer film and to contact said solid detergent to create a use-dilution solution.

44. The method of claim 43 wherein said alkaline cleaning article comprises a unit dose.

45. The method of claim 43 wherein said alkaline cleaning article comprises a solid alkaline detergent composition capable of more than one use.

46. The method of claim 43 wherein said alkaline cleaning article is used through an automatic dispensing machine.

47. The method of claim 43 wherein said alkaline cleaning article is applied through the manual application of an aqueous solution to the system.

48. A cleaning system comprising a dispenser and an alkaline cleaning article, said article comprising:

(a) a solid detergent composition having a pH greater than 10.5 when diluted to a 1 wt-% aqueous solution said detergent comprising a source of alkalinity, said alkalinity source selected from the group consisting of a silicate, an alkali metal hydroxide, a phosphate, a carbonate, and mixtures thereof; and (b) a continuous multilayer polymeric film, dispersible or soluble in aqueous liquids, covering the solid detergent composition, said multilayer film comprising an inner alkali pH stable and aqueous soluble film and an outer layer resistant to aqueous dissolution and effective in providing mechanical strength wherein said multilayer film remains mechanically stable and aqueous soluble or dispersible after exposure to the solid detergent composition.

49. The system of claim 44 wherein said polymeric film covers substantially the entirety of the solid detergent composition.

50. The system of claim 44 wherein said continuous polymeric film comprises a vinyl polymer.

51. The system of claim 44 wherein said inner layer and said outer layer are joined by a plurality of randomly distributed film to film bonds.

52. The system of claim 44 wherein said inner layer and said outer layer are joined by coextensive layer to layer lamination.

53. The system of claim 48 wherein said continuous polymeric film comprises an inner alkali stable and aqueous soluble layer, an outer cold water resistant layer, and an intermediate structural layer.

54. The system of claim 44 wherein said polymeric film has a thickness ranging from about 0.6 mil to about 15 mil.

55. The system of claim 53 wherein said polymeric film comprises three layers.

* * * * *